US006222573B1

(12) United States Patent
Shibuki et al.

(10) Patent No.: US 6,222,573 B1
(45) Date of Patent: Apr. 24, 2001

(54) RECORDING APPARATUS

(75) Inventors: Takashi Shibuki, Chiba; Takeo Katsuda, Sagamihara, both of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/129,303

(22) Filed: Aug. 5, 1998

(30) Foreign Application Priority Data

Aug. 6, 1997 (JP) ..... 9-212123

(51) Int. Cl.[7] ..... B41J 2/36

(52) U.S. Cl. ..... 347/188; 347/240; 347/251

(58) Field of Search ..... 347/183, 184, 347/188, 191, 240, 251, 254, 6; 358/521, 534, 456, 298; 399/49, 58, 60

(56) References Cited

U.S. PATENT DOCUMENTS 4,462,680 * 7/1984 Ikeda ..... 399/58
5,974,229 * 10/1999 Yoshino ..... 347/6
6,055,011 * 4/2000 Nishimura ..... 347/254

FOREIGN PATENT DOCUMENTS 7-68823 3/1995 (JP) .

* cited by examiner

*Primary Examiner*—N. Le
*Assistant Examiner*—Hai C. Pham
(74) *Attorney, Agent, or Firm*—Sidley & Austin

(57) ABSTRACT

In a heat transfer recording apparatus for printing on photographic print paper using an ink film coated with sublimable ink, density unevenness that occurs at the edges of the wide printing paper is prevented by compensating density in the area that corresponds to the difference between wide print paper and narrow print paper.

18 Claims, 14 Drawing Sheets

COMPENSATION TABLE

| NORMAL VALUE | COMPENSATION VALUE |
|---|---|
| 0 | $\alpha 0$ |
| 1 | $\alpha 1$ |
| 2 | $\alpha 2$ |
| • | • |
| • | • |
| • | • |
| 253 | $\alpha 253$ |
| 254 | $\alpha 254$ |
| 255 | $\alpha 255$ |

RECORDING APPARATUS

BACKGROUND OF THE INVENTION

1. Field of the Invention

The invention relates to a recording apparatus, in particular, to a heat transfer recording apparatus using an ink film wherein characters and/or graphic images are formed on recording paper of various widths.

2. Description of the Related Art

A heat transfer recording apparatus such as a printer comprises a platen roller and a thermal head that can be arbitrarily pressed against the platen roller. The recording paper is transferred together with the ink film between the platen roller and the thermal head to allow characters and/or graphic images printed thereon. The ink film has thermally fusing or sublimating type of inks coated on one side thereof. The ink is fused or sublimated to be fixed on the recording paper by means of the heat of the thermal head.

A heat transfer recording apparatus is normally capable of printing onto various sizes of recording paper. For example, recording paper larger than A4 in addition to paper of sizes as small as A6 paper, post card, card-size paper can be optionally applied to the recording apparatus.

However, a problem has been noticed of such an apparatus that, after having been used for some time, the printing density becomes uneven across the width of the paper depending on how often the apparatus has been used. More specifically, when an image of a uniform density is printed on a wide sheet of recording paper, the printed image becomes darker in the midsection of the paper than on the edges of the width.

It is caused by the fact that the midsection of the platen roller and the thermal head where all sizes of paper pass wear more rapidly than the edges where only larger sizes of paper pass, thus increasing the heat conductivity in the midsection.

This problem can be eliminated by replacing the platen roller and/or thermal head when it is found that the density unevenness develops between the midsections and the edges of the recording paper. However, this method is not recommendable because of the resultant increase of the running cost.

SUMMARY OF THE INVENTION

The purpose of the invention is to prevent the density unevenness developing between the midsections and the edges of a recording paper on a recording apparatus that forms images on the paper of different sizes using the ink film with ink layers formed thereon.

One aspect of the present invention is a recording apparatus for forming images on recording paper with varying widths using an ink film with ink layers formed thereon, the recording apparatus comprising a density controller that makes density compensation in a range which corresponds to difference in width between wide recording paper and narrow recording paper.

Another aspect of the present invention is a recording apparatus for forming images on recording paper with varying widths using an ink film with ink layers formed thereon, the recording apparatus comprising: a detector which detects image density in a plurality of different positions of recording paper; a calculator which calculates density compensation amount based on the detected image density; and a density controller which makes density compensation corresponding to the calculated density compensation amount.

The objects, features, and characteristics of this invention other than those set forth above will become apparent from the description given herein below with reference to preferred embodiments illustrated in the accompanying drawings.

DETAILED DESCRIPTION OF THE PREFERRED EMBODIMENT

The embodiments of this invention will be described below with reference to the accompanying drawings.

Figure 1:
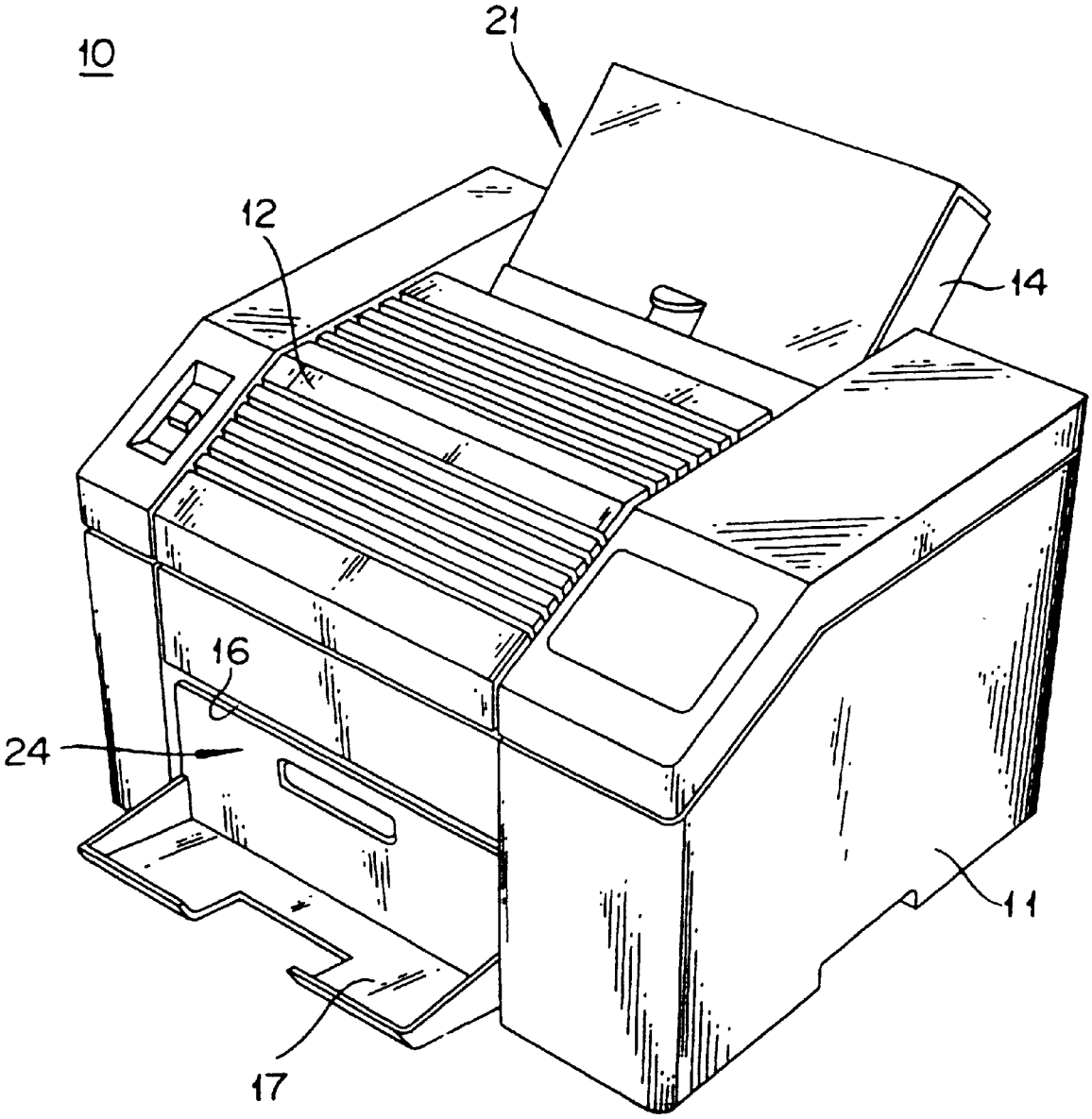
FIG. 1 is an external perspective view of a heat transfer recording apparatus according to an embodiment of the present invention.

FIG. 1 is an external perspective view of a heat transfer recording apparatus according to an embodiment of the present invention. For the sake of convenience in the following description, the edge of the recording paper which leads the paper when it is being discharged will be called the leading edge.

The recording apparatus 10 is used, for example, in a photofinisher, where photographs are printed for the purpose of index printing or reproducing the information recorded on multiple frames of a negative film on a sheet of recording paper. A control device (not shown), which conducts various image processing to the image information read from a negative film, is connected to the recording apparatus 10 via an interface, so that image signals and control signals from the control device can be delivered. The recording apparatus 10 can also be connected to a computer to print the images prepared by the computer as well.

Figure 2:
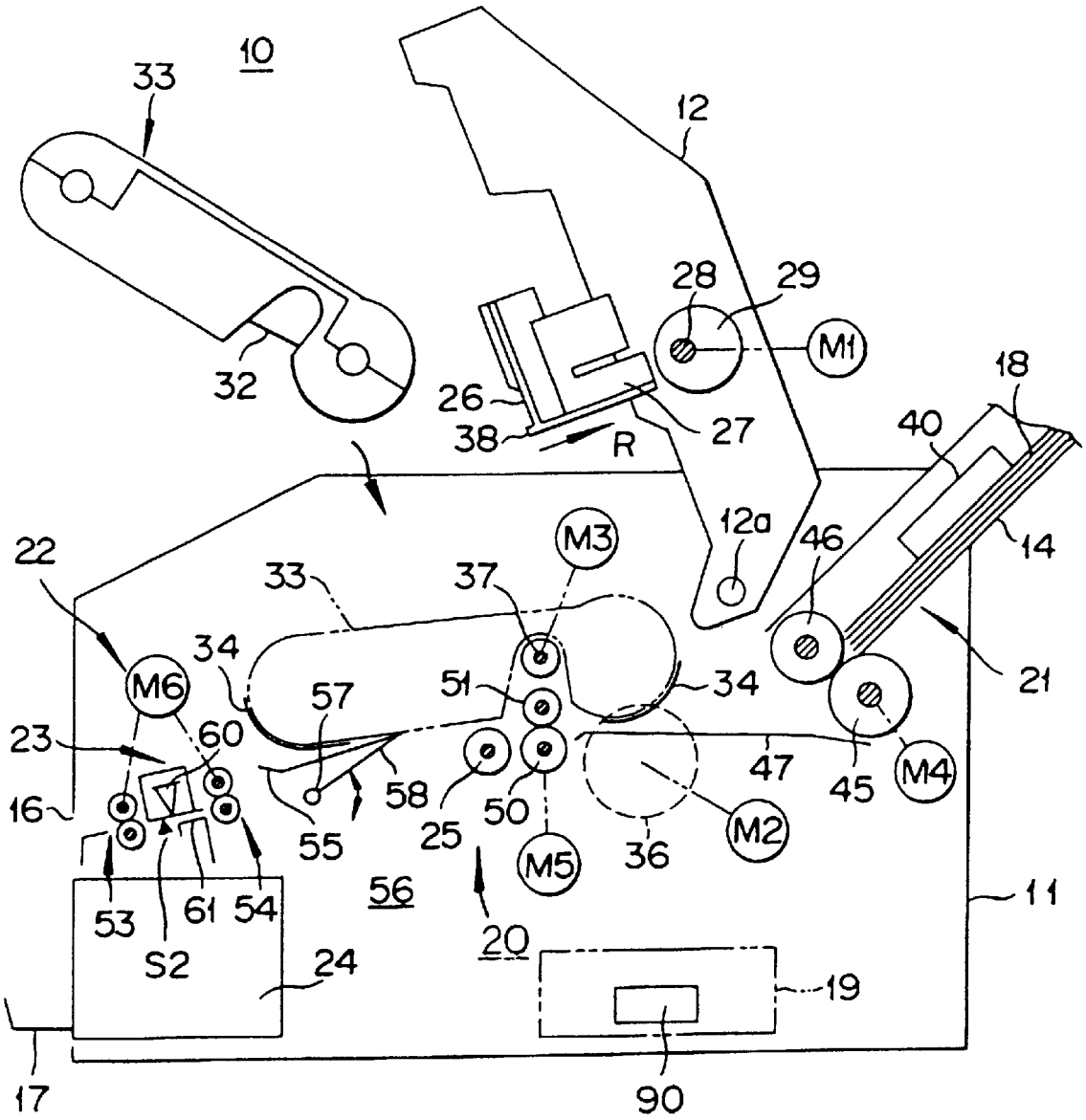
FIG. 2 is a cross-sectional view of the recording apparatus of FIG. 1 with its cover opened.

A housing 11 which constitutes the main body of the recording apparatus 10 has a cover 12 that can be opened around a swivel shaft 12*a* (FIG. 2). This enables the ink film cassette to be loaded into a desired position within the housing 11 when the cover 12 is opened. A paper discharge section is provided on the front end of the recording apparatus 10, while a paper feed unit 21 is provided on the back end. The front end of the apparatus 10 is on the left side of this drawing.

A paper supply tray 14 that stocks many sheets of paper is provided in the paper feed unit 21 in a tilted position. The recording apparatus 10 comprises also a cutting section to cut off useless portions (leading and/or trailing ends) of the recording paper after the image has been reproduced as well as a scrap reception unit 24 that stores paper scraps produced as a result of the cutting. The reception unit 24 is provided at the front end of the apparatus in a removable manner. The recording paper, whose useless portions have been cut off, is discharged through a discharge opening 16 in a vertical direction on a discharge tray 17 provided as an integral part of the front surface of the reception unit 24.

As mentioned before, the paper supply tray 14 is provided in a tilted position and the recording paper is discharged in a vertical direction. Therefore, the dimension that the discharge tray 17 protrudes from the front surface of the housing 11 is relatively small. Hence, the overall installation space requirement of the recording apparatus 10 is minimal, making it a unit suitable for installation in a narrow place.

The recording apparatus 10 uses an ink film coated with thermally sublimable inks as well as thick (150–250 $\mu$m) and sturdy recording paper such as photographic paper as the image receiving paper to trap the sublimated inks.

Figure 3:
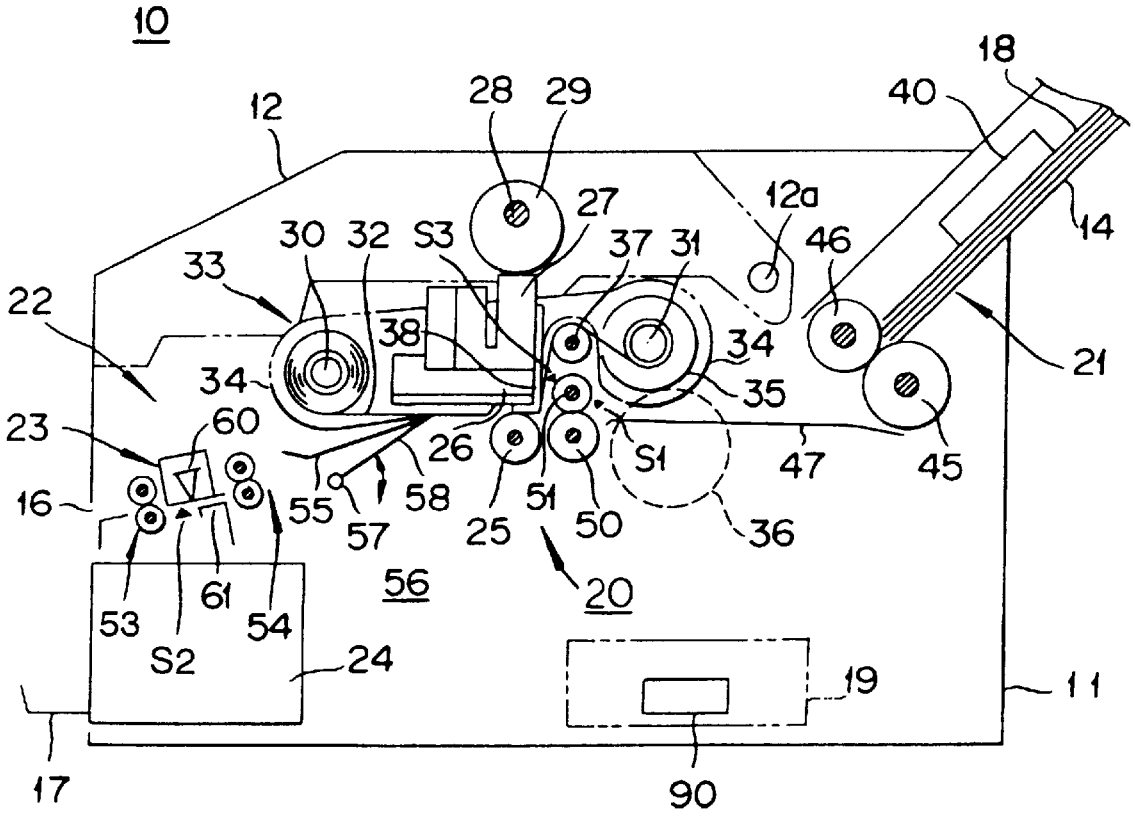
FIG. 3 is a cross-sectional view of the recording apparatus of FIG. 1 with a cassette loaded into its main body.
Figure 4A:
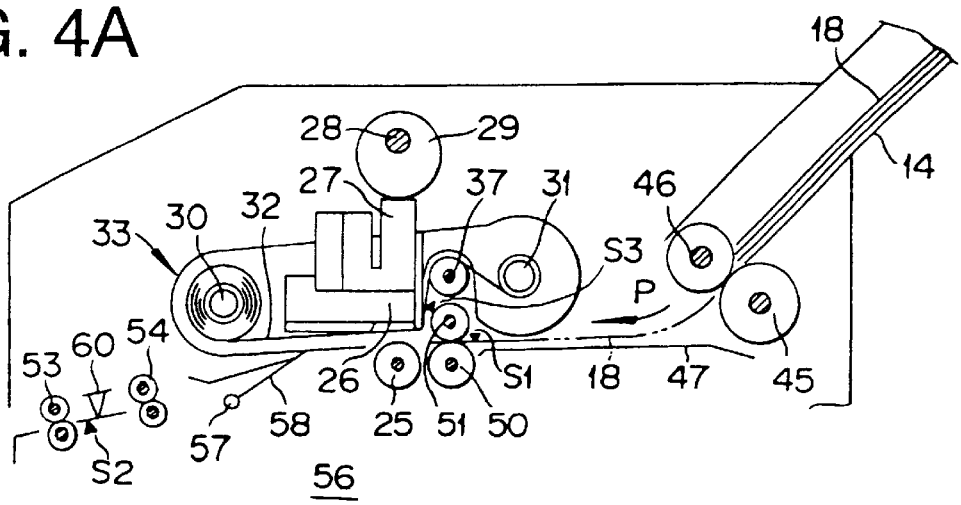
FIGS. 4A–4C are partial cross-sectional views of the recording apparatus of FIG. 1 showing operations during paper feed, at the start of printing, and at the end of printing, respectively.
Figure 4B:
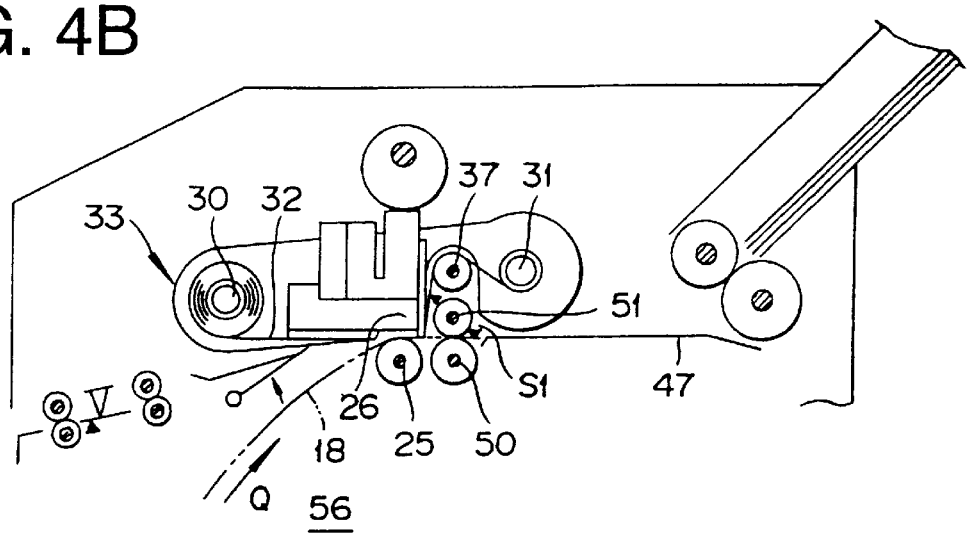
Figure 4C:
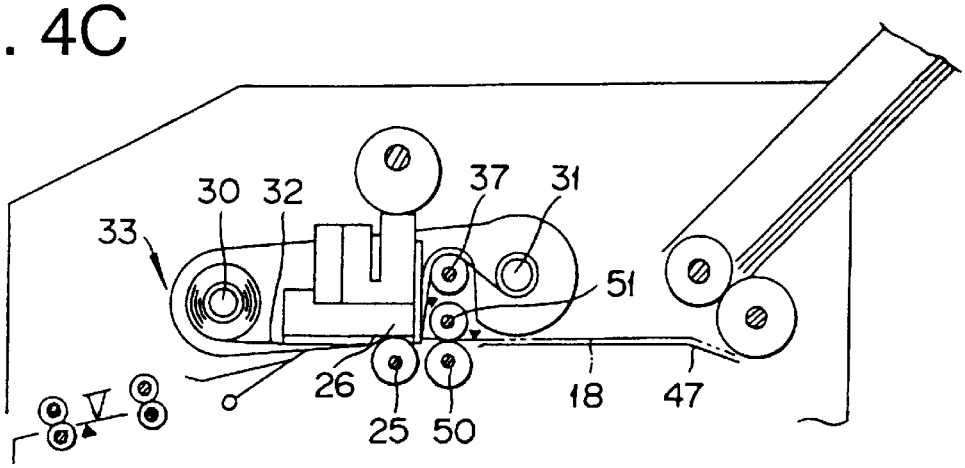

FIG. 2 is an outline cross section of the heat transfer recording apparatus with a cover opened. FIG. 3 is an outline cross section of the heat transfer recording apparatus with a cassette loaded into its main body. And FIGS. 4A through 4C are the cross sections of the heat transfer recording apparatus showing outlines of operations during paper feed, at the start of printing, and at the end of printing respectively.

Let us first describe the internal structure of the heat transfer recording apparatus 10.

As shown in FIGS. 2 and 3, the heat transfer recording apparatus 10 comprises a print section 20, which is located approximately in the middle, the paper feed unit 21, which is located at the back upper end of the apparatus in a 45 degrees tilted position, and a paper discharge section 22, which is provided on the opposite side of the paper feed unit 21 across the print section 20. The print section 20 transfers recording paper 18 approximately straight in order to improve the print quality for thick and sturdy recording paper 18.

As mentioned before, the installation space requirement is minimized by providing the paper feed unit 21 in a tilted position. Moreover, since the paper discharge section 22 is provided on the opposite side of the paper feed unit 21 across the print section 20, the unit can be used in a manner similar to that of a facsimile machine, making it a more acceptable apparatus for users. The paper discharge section 22 is provided with the cutting section 23 that cuts off useless sections of the recording paper 18 after the image has been reproduced, and the reception unit 24 underneath it.

Let us now describe the internal structure of the heat transfer recording apparatus 10.

A platen roller 25 is rotatably held inside the housing 11. A head base 27 having a thermal head 26 is provided inside the cover 12 in such a way as to make it movable relative to the platen roller 25 by means of a linking member not shown. When the head base 27 advances toward the platen roller 25, the thermal head 26 moves to a position to press against the platen roller 25. When the head base 27 moves away from the platen roller 25, the thermal head 26 moves to a position where it no longer presses against the latter. The head base 27 is constantly pushed by an urging force of a spring (not shown) in the direction of an arrow R shown in FIG. 2 to keep the thermal head 26 away from the platen roller 25 to a position where it does not press against the latter.

An eccentric cam 29 is fixed to a driving shaft 28, which is attached rotatably to the cover 12. The eccentric cam 29 is used to make contact with and move the head base 27 so that the thermal head 26 will be pressed against the platen roller 25. A thermal head driving motor Ml as a pulse motor is connected to the driving shaft 28 to rotate the eccentric cam 29 thus to move the thermal head 26.

As shown in FIG. 3, a ribbon-like ink film 32, which is supplied from a supply reel 30, is transferred between the thermal head 26 and the platen roller 25 to be taken up by a take-up reel 31. A base film of the ink film 32 is coated with three layers of inks, i.e., yellow, magenta, and cyan, as well as a top coat layer in that order side by side, repeatedly in a direction perpendicular to its lengthwise direction of the film. Incidentally, an ink film in four colors having black ink layer in addition to yellow, magenta, and cyan ink layers is applicable. The supply reel 30 and the take-up reel 31 are held in a cassette 33. The cassette 33 is loaded into the housing 11 in a removable manner by being set on a holding plate 34, which is attached to the housing 11. When the cassette is loaded, a gear 35, attached to the take-up reel 31 and partially exposed through an opening formed on the cassette 33, engages with a driver gear 36 provided on the apparatus side. The driving gear 36, which is driven by a motor M2, is used to take up the ink film 32 by means of the take-up reel 31.

A take-up roller 37 of the ink film is provided in the vicinity of the platen roller 25. The take-up roller 37 is used to form a transfer route for the ink film 32 when the cassette is loaded. The take-up roller 37 is normally free-wheeling but becomes capable of being driven by the ink film take-up motor M3 when a clutch (not shown) is connected, thus to move the ink film 32, when the apparatus is not printing. When it is printing, however, the ink film 32 is fed out in coordination with the transfer of the recording paper 18, guided by a guide plate 38 attached to the edge of the thermal head 26 and the take-up roller 37, which is now free-wheeling, and taken-up by the take-up reel 31.

The paper supply tray 14 has width regulating plates 40 to regulate the width direction of the recording paper 18 held in the paper supply tray 14 in a tilted position. The width regulating plates 40 are freely adjustable widthwise according to the size of the recording paper 18.

The recording paper 18 held in the paper supply tray 14 is supplied one sheet at a time with the help of a paper feed roller 45 and a paper guide roller 46, which is placed facing the paper feed roller 45 across a tiny gap, and transferred guided by a guide 47. The paper feed roller 45 is driven by a pulse motor M4, while the paper guide roller 46 is not rotatable.

The surface of the paper guide roller 46 is coated and its hardness is 70. The gap mentioned above is set at about 0.3 mm which is selected by a certain margin to the paper thickness. By having such structures, even a thick recording paper 18 can be smoothly fed and cause no scratches on the surface of the recording paper 18.

Adjacent to and on the upstream-side of the platen roller 25 provided are a grip roller 50 and a pinch roller 51 that abuts the grip roller 50. The upcoming recording paper 18 is fed into the gap between the rollers 50 and 51. The grip roller 50 is driven by a pulse motor M5. The pinch roller 51 rotates as it is driven by the recording paper being transferred.

On the downstream-side of the platen roller 25 provided are a first pair of discharge rollers 53 located on the side of the discharge opening 16 and a second pair of discharge rollers 54 located on the side of the platen roller 25 in order to discharge the recording paper 18 on the discharge tray 17. The discharge rollers 53 and the discharge rollers 54 are placed across a certain distance and are driven by a pulse motor M6.

A guide 55 is provided between a platen roller 25 and the discharge rollers 54 to guide the transfer of the recording paper 18. A space 56 is formed underneath the guide 55 to store the recording paper 18 during printing.

In reproducing color images on the recording paper 18, the recording paper 18 is first supplied from the paper supply tray 14 and transferred into the direction indicated by an arrow P as shown in FIG. 4A. The recording paper 18 is stored in the space 56 as shown in FIG. 4B. Next, the yellow image is printed on the recording paper 18 while it is being transferred in a reverse direction indicated by an arrow Q. This process will be referred as a reverse printing process in this application.

After the yellow image has been copied using the reverse printing process, the recording paper 18 is transferred forward in preparation for the reproduction of the next image, or the magenta image. Thus, three color images, for example, are printed one on top of the other on the recording paper 18, to form a full-color image.

The thermal head 26 is pressed against the platen roller 25 only during the reverse transfer motion. In other words, the thermal head 26 is separated from the platen roller 25 when the recording paper 18 is being transferred forward. Also, the grip roller 50 and the pinch roller 51 are pinching the recording paper 18 all the time during the reverse and forward transfer motions repeated during the printing process.

A swivel guide 58 that swivels back and forth around its supporting shaft 57 is provided underneath the guide 55. The swivel guide 58 is used to guide the recording paper 18 received from the grip roller 50 and the pinch roller 51 either to the paper discharge section 22 where the discharge rollers 53 and 54 are provided or to the space 56. The swivel guide 58 is made of a flexible material.

The recording paper 18 will be stored in the space 56 when the swivel guide 58 is swiveled upward as shown in FIG. 4B. Incidentally, the recording paper 18 is transferred toward the paper discharge section 22 when the swivel guide 58 is swiveled in the clockwise direction around the support shaft 57 from its up position to its down position.

In order to improve the print quality, it is necessary to make the recording paper 18 not to be pinched between the discharge rollers 53 and the discharge rollers 54.

Also, by providing a swivel guide 58, the distance between the platen roller 25 and the discharge rollers 53, 54 can be reduced in forming the space 56 underneath the transfer route to the paper discharge section 22. This, in turn, reduces the installation space requirement of the recording apparatus 10.

The cutting section 23 for cutting the recording paper 18 is provided between the first pair of discharging rollers 53 and the second pair of discharging rollers 54. The cutting section 23 includes a rotary cutter 60 and a receiving table 61 that operates in coordination with the rotary cutter 60. Scraps of the recording paper, which consists of unprinted areas cut off by the cutting section 23, drop by their own weights to the reception unit 24 provided underneath of the cutting section 23 to be collected.

As shown in FIG. 1, the reception unit 24 and the discharge tray 17 are assembled together as one piece. As a result, when an operator collects the printed recording paper 18 from the discharge tray 17, the operator will automatically see the reception unit 24 located behind the discharge tray 17, and the operator will subconsciously confirm the condition of scrap paper piled in the reception unit 24.

The recording apparatus 10 is also equipped with a sensor S1 placed adjacent to the grip roller 50 to detect the leading edge of the recording paper during the paper supply process, or the trailing edge of the recording paper during the printing process. The sensor S1 issues an ON signal when it detects the leading or trailing edge of the recording paper 18. Since the sensor S1 detects the trailing edge during the printing process, it will be called for the sake of convenience the trailing edge sensor S1.

As shown in FIG. 2, the cutting section 23 has a leading edge sensor S2 to detect the leading edge of the recording paper. The leading edge sensor S2 issues an ON signal when it detects the leading edge of the recording paper 18. The pulses for driving the transfer motor M6 are controlled with the time when the leading edge sensor S2 detects the leading edge of the recording paper 18 as the reference point, and is used for the leading edge cut that cuts off a predetermined length of paper from the leading edge of the recording paper 18, or the trailing edge cut that cuts off a predetermined length of recording paper 18 from the trailing edge.

Also, a control unit 19 is provided in the low inside area of the recording apparatus 10 as shown in FIG. 2 and FIG. 3. The control unit 19 has a power source unit that supplies the outside power, a controller 90 such as CPU and various circuit boards that receive signals via an interface from a control device (not shown) provided outside of the apparatus and controls various parts of the apparatus.

Figure 5A:
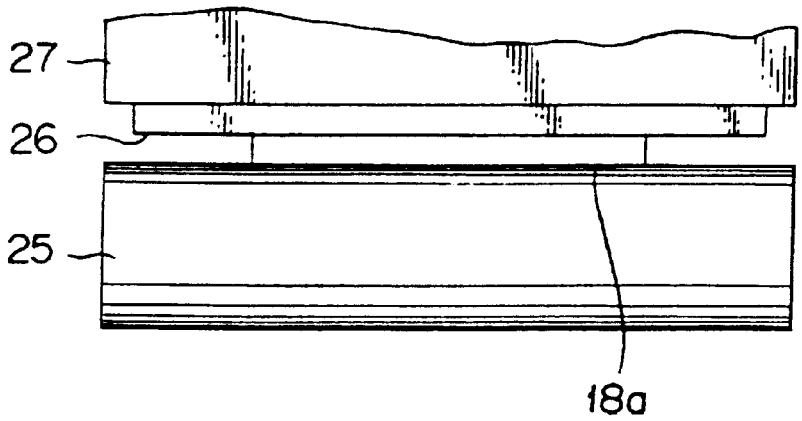
FIG. 5A and FIG. 5B are enlarged views of a narrow sheet of recording paper and a wide sheet of recording paper, respectively, moving through a platen roller nip part of the recording apparatus of FIG. 1 as seen in the direction of recording paper feed.
Figure 5B:
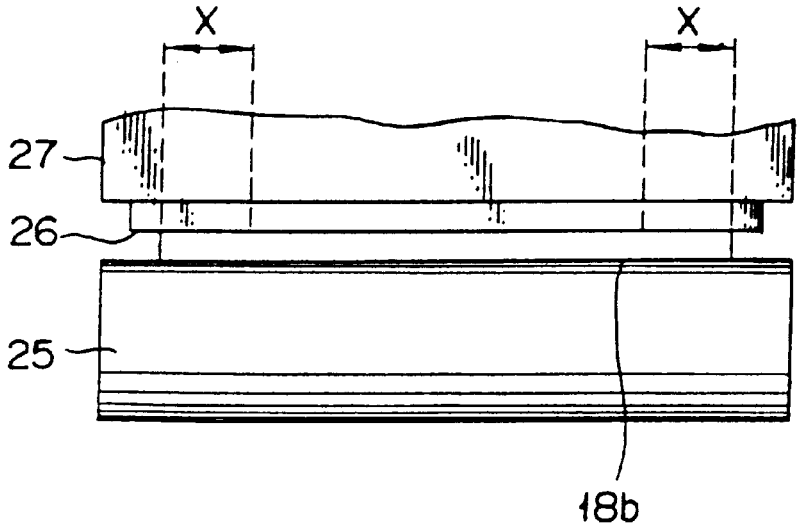

FIGS. 5A and 5B are enlarged views of the paper pass area or the nip part between the platen roller and the thermal head as seen from the direction of the paper feed.

As shown in FIG. 5A, a narrow sheet of recording paper 18*a* passes through between the midsections of the platen roller 25 and the thermal head 26. Consequently, the midsections through which the recording paper 18*a* passes generates a stronger rubbing action with the ink film compared to the edges where the recording paper 18*a* does not pass through. And the midsection of the thermal head 26 wears more than at the edges as the apparatus is used so that the thermal conductivity in the midsection increases.

Figure 6:
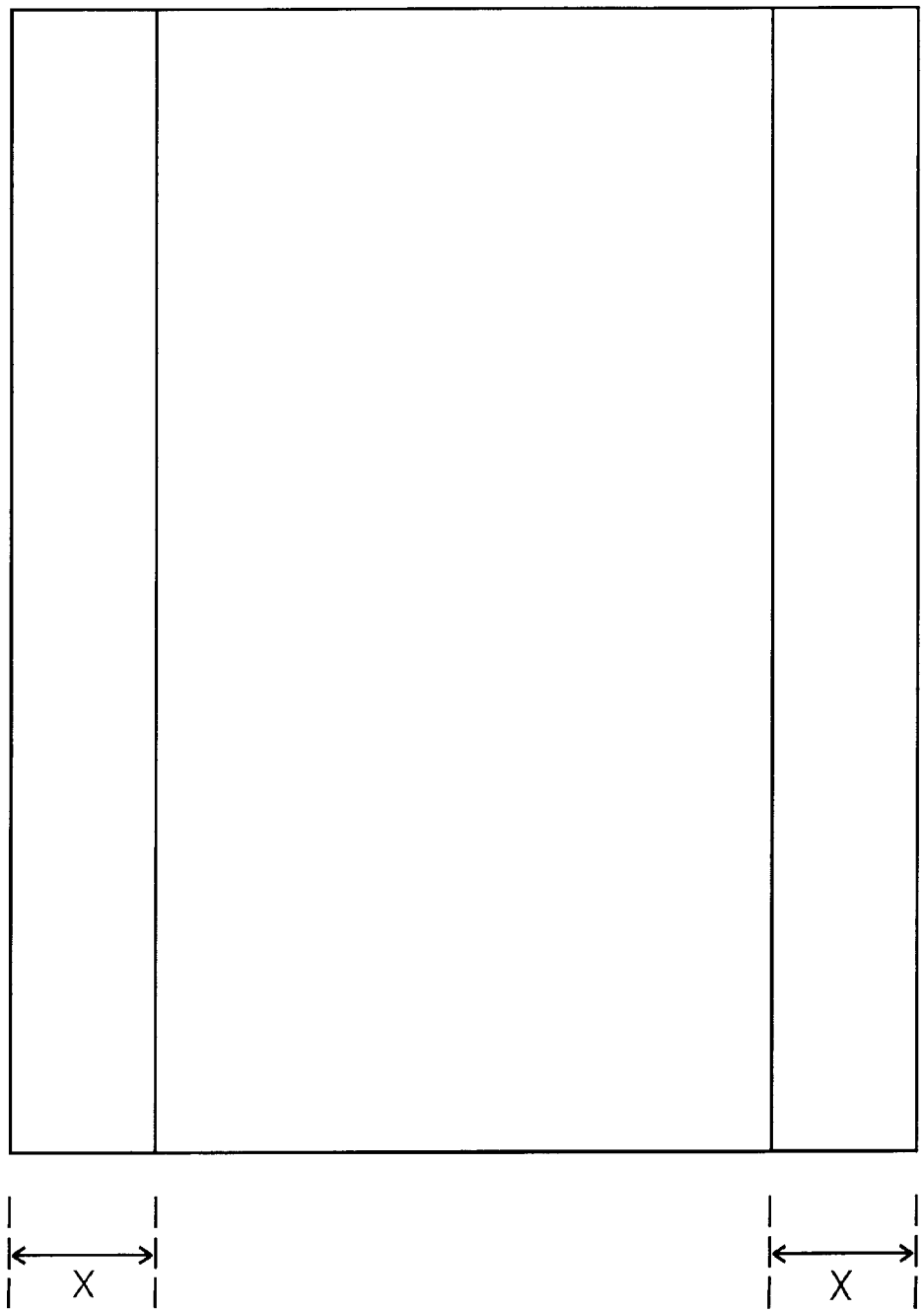
FIG. 6 is an explanatory drawing showing regions of density unevenness when printing was made on a wide sheet of recording paper, using a prior apparatus.

When printing is made on a wide sheet of recording paper 18*b* as shown in FIG. 5B using a thermal head 26 under such a condition, the density at the edges X, as shown in FIG. 6, becomes thinner.

In the present embodiment, the density of the edges is intentionally intensified to compensate for the unevenness of the density that happens when printing is made on a wide sheet of recording paper.

Figure 7:
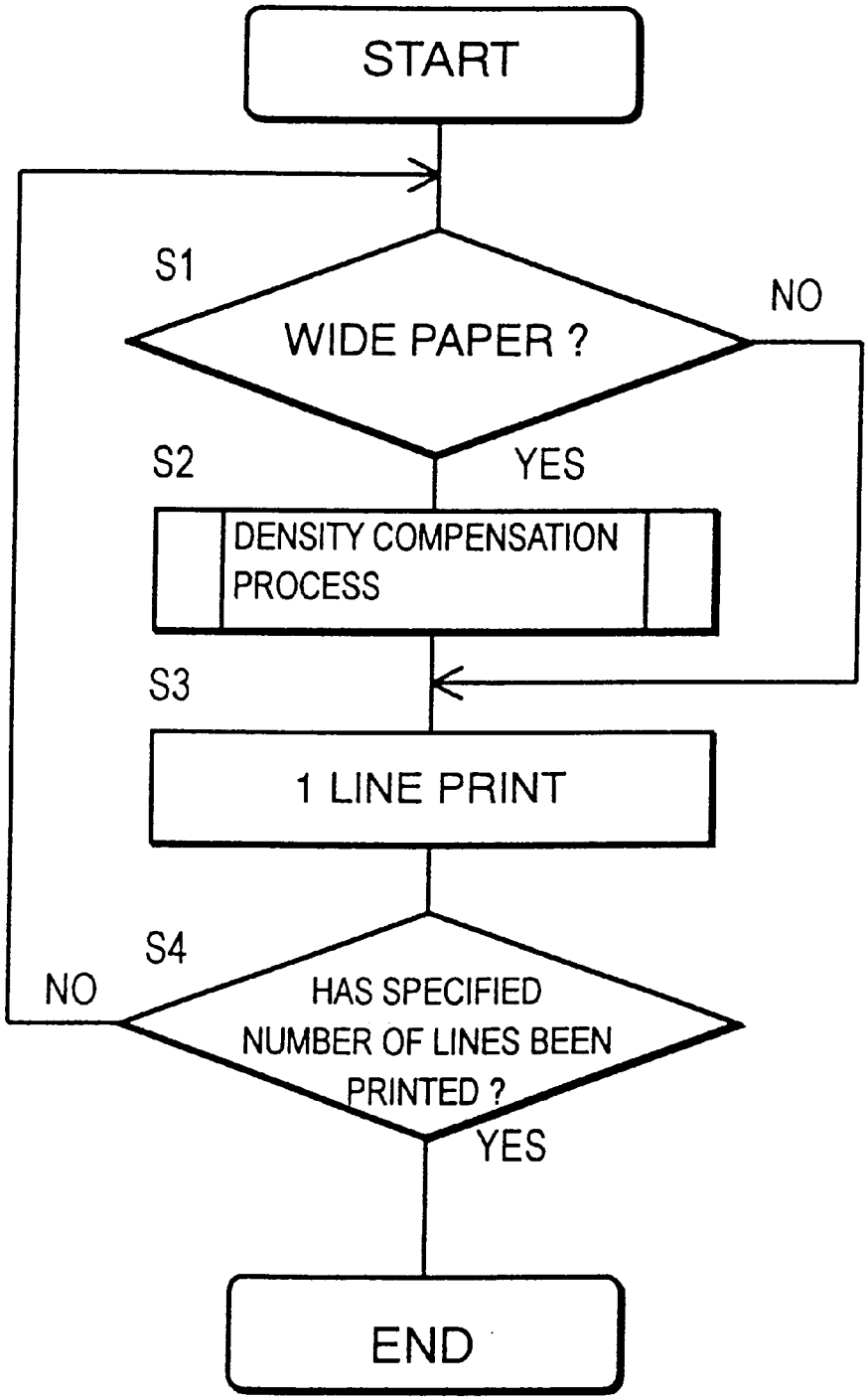
FIG. 7 is a flow chart illustrating the procedure, according to an embodiment of the present invention, of compensating for printing density unevenness.

FIG. 7 is a flow chart showing the operation procedure of the density compensation. As examples, let us describe the printing processes on two different kinds of recording paper with different widths as shown in FIG. 8.

Figures 8, 9:
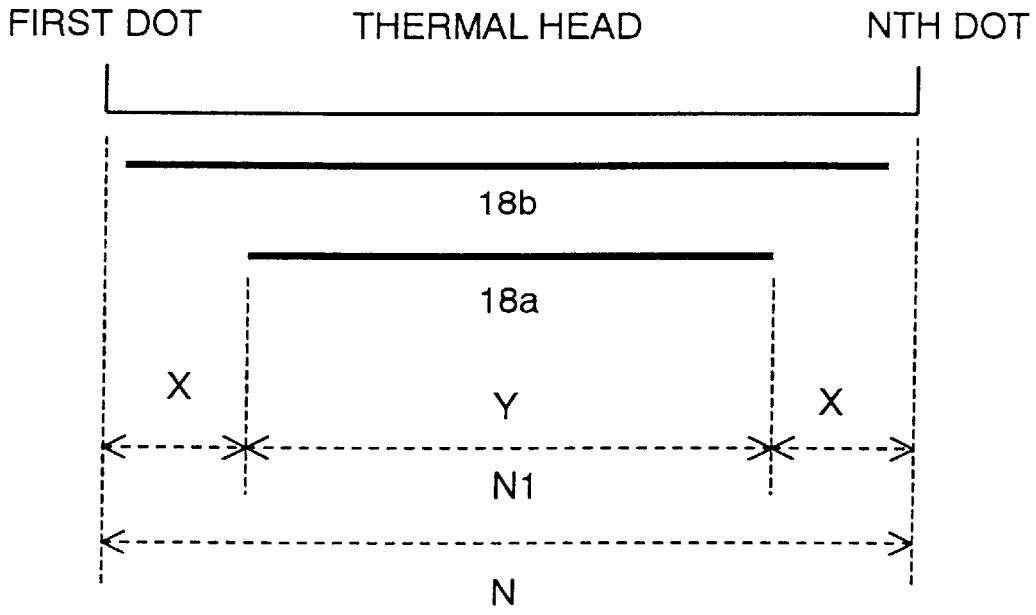
FIG. 8 is a view describing the required compensation ranges for different paper widths.
FIG. 9 is an example of a compensation table.

FIG. 8 shows a narrow sheet of recording paper 18*a* and a wide sheet of recording paper 18*b*. The required range of compensation is the width difference between 18*a* and 18*b*. Assuming that the total number of print dots of the thermal head is N and the number of dots used for printing on a narrower sheet of paper 18*a* is N1, the required ranges of compensation are as shown in Table 1. In the table, X represents the compensation range and Y represents the no-compensation range.

TABLE 1

| Dot position | |
|---|---|
| From 1st to $\frac{(N - N1)}{2}$ th | Compensation range X |
| From ( $\frac{(N - N1)}{2}$ + 1) th to $\frac{(N + N1)}{2}$ th | No-compensation range Y |
| From ( $\frac{(N + N1)}{2}$ + 1) th to Nth | Compensation range X |

If printing is done using with an equal density in the direction of the thermal head motion as usual, or if the same output of the thermal head is used for both ranges X and Y, the printed density in the range X where compensation is required becomes thinner than in the range Y where no compensation is required. Therefore, in the present embodiment, the output of the thermal head in the range X is determined according to the compensation table shown in FIG. 9. The compensation table provides the compensation value relative to the normal value in the range X where compensation is required, which will be explained later in detail. The compensation table is stored either in the control unit of the recording apparatus 10, in the external control device, or in the computer.

The actual compensation procedure is as shown in FIG. 7. First of all, a judgment is made whether the width of the recording paper is larger than the desired value (S1). If the width of the recording paper is larger than the desired value, the density of the image data will be compensated according to the compensation table (S2), and one line of information is printed using compensated data (S3). Next, a judgment is made whether a certain specified number of lines of printing has been completed based on the total number of lines of the image instructed from the control unit, the external control device, or the computer (S4). If it hasn't been finished, the process from the steps S2 through S4 will be repeated until all the specified number of lines are printed. Incidentally, the transfer of the recording paper is properly done while synchronized with and parallel to this flow chart.

The desired value used for the judgment of the width of the recording paper in the step S1 corresponds to the recording paper size preset using the operating panel (not shown) of the recording apparatus 10, or the recording paper size instructed from the external control device or computer.

Figure 10:
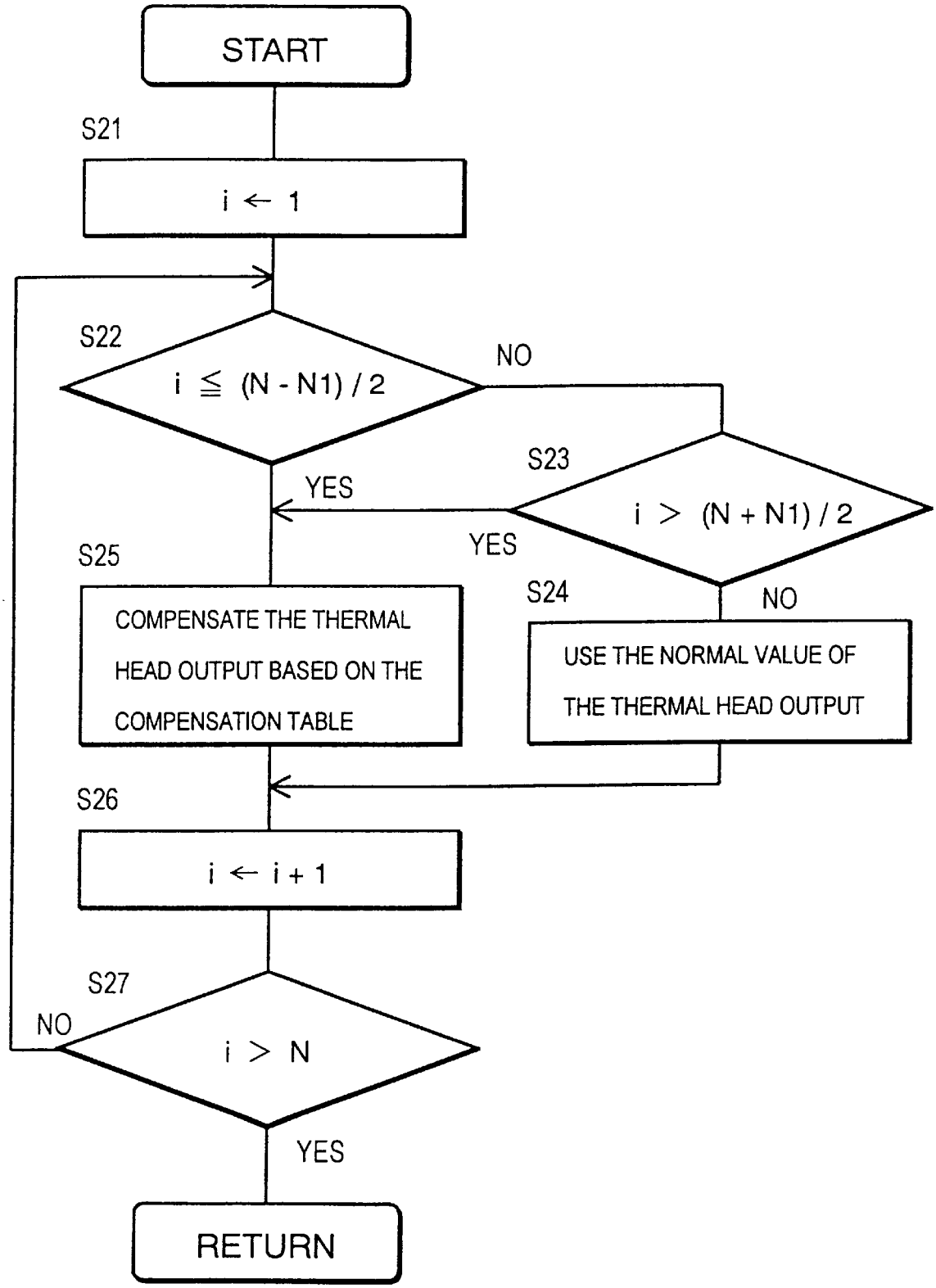
FIG. 10 is a flow chart of the density compensation procedure shown as step S2 in FIG. 7.

FIG. 10 is a flow chart of the density compensation procedure used in the step S2.

First of all, a variable "i" which represents the dot position within one line is set to 1 (S21). Next, it is judged whether the variable "i" is located within the compensation range (S22 and S23). If the variable "i" is determined that it is outside of the compensation range, the normal value will be inputted to the thermal head without any compensation (S24).

On the other hand, if the variable "i" is judged to be located within the compensation range, the compensation value corresponding to a normal value is determined, and is inputted into the thermal head (S25).

Next, the variable "i" is incremented by 1 (S26), and a judgment is made whether the variable "i" has exceeded N, the total number of dots in a line (S27). If the judgment is negative, the steps S22 through S27 are repeated until the outputs of the total range of dots of the thermal head are determined.

Proper compensation is made to each print density specified for each dot following the procedure described in the above. Thus, even if a wide sheet of recording paper is to be printed, the density unevenness between the midsection and the edges do not occur and a nice printing results.

Next, let us explain about how the compensation values of the table are determined.

The purpose of the compensation values is to attenuate the density unevenness in order to print the edges of the recording paper with the same density as in the midsection. The reason the compensation is needed is that the midsection of the thermal head wears as the apparatus is used. Therefore, by determining the compensation amount according to the wear in the midsection of the thermal head, accurate density compensation can be achieved. In the present embodiment, a compensation table is prepared in advance based on the wear indirectly estimated from the number of sheets of printed recording paper.

For example, the compensation table to be used after printing one million lines is prepared by: printing one million lines using a new thermal head which has never been used before on narrow recording paper; and printing for each gradation on wide recording paper to determine a proper output that balances the density of the range X where compensation is required with that of the range Y in the midsection of the recording paper where no compensation is needed.

If the service life of the thermal head is assumed to be printing 100 million lines, compensation tables for every one million lines up to 100 million lines are prepared and stored in the memory. By selecting and applying one of the prepared tables according to the actual number of print lines made on the machine using narrow recording paper, the accurate compensation is accomplished. The same table prepared for each step of printing one million lines using one test machine is applicable to all machines of the same model. Incidentally, if it is the same model, storing the above-mentioned compensation tables allows each machine to operate with proper compensation based on the number of print lines made on the machine using narrow recording paper.

It is also possible, in case of a machine already being used in the field to: prepare a compensation table for each step of printing one million lines; store the table in an external control device or a computer; and use the data retrieved from the compensation table stored in the external control device or the computer until the line counting reaches the next one million mark.

The print line counting can be substituted by counting the number of printed sheets.

Let us assume A6 size recording paper as a type of narrow width paper is transferred with the lengthwise direction of the recording paper along the thermal head or with the transfer direction matching the shorter side of the paper, to be printed in color. The number of print lines per sheet of recording paper is about 1250 lines per color since the length of the A6 paper along the transfer direction is 105 mm and the resolution used is 300 dpi (dots per inch). Supposing that four colors (yellow, magenta, cyan and black) are printed in color printing, the total number of lines printed per sheet is 5000 lines. Therefore, printing one million lines corresponds to printing 200 sheets. Thus, the number of printed sheets is counted and when the count reaches 200, the compensation table is switched to the next table.

According to the description up to this point, ideal situations have been assumed in that the centers of the wide and narrow sheets of recording paper are assumed to be aligned with the centerline of the thermal head width. In reality, however, the centerline of a sheet of recording paper is not necessarily aligned with the center of the thermal head. This is due to the effect of the assembly accuracy. Under normal circumstances, the paper can be offset as much as 20 dot counts or about 2 mm relative to the thermal head.

Therefore, it is preferable that the range X where compensation is required is adjustable for the recording paper offset relative to the centerline of the thermal head.

One possibility is to measure the exact position of the recording paper relative to the thermal head using sensors to know the offset and define the compensation-requirement range X specifically according to the offset. However, in order to detect a small offset such as 2 mm, high precision sensors and a sensitive control circuit become necessary and may make it prohibitive from the cost standpoint.

In the present embodiment, in order to provide proper compensation considering the recording paper offset without causing any apparatus cost increase, actual or original print images are used as the reference images for detecting density unevenness. The scheme is, as shown in FIG. 11, to measure the width of the ranges Xa and Xb where the density is thinner, to calculate the recording paper offset in terms of the number of dots from the difference of the widths, and to supply the offset A of the compensation required range from the external computer.

Figure 11:
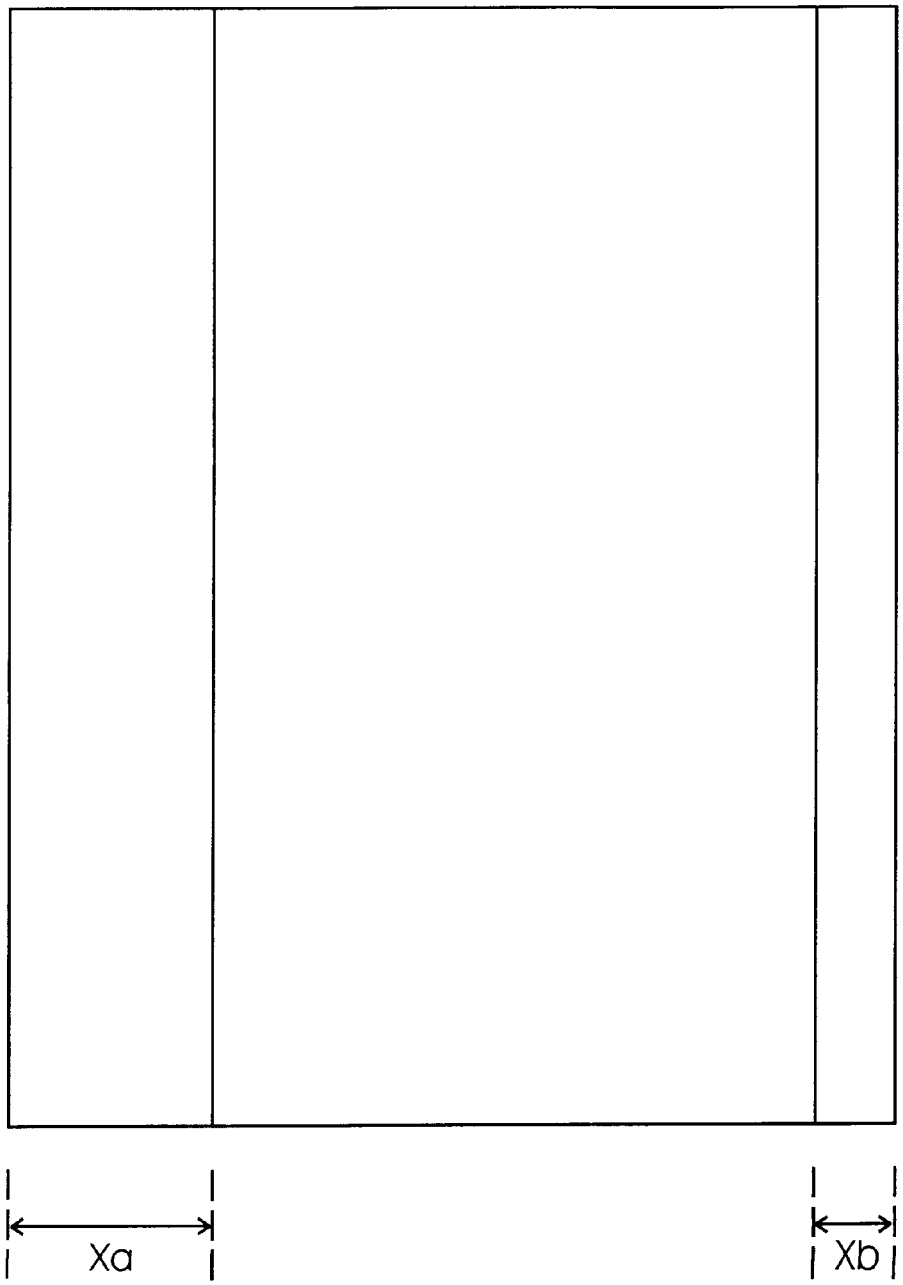
FIG. 11 is a view of a printed image showing regions of uneven density related to another embodiment of the present invention.

More specifically, the ranges Xa and Xb are measured from the regions shown in FIG. 11. Next, Δ(Xa–Xb) [mm] or the difference between the ranges Xa and Xb is calculated. For example, if the resolution is 300 dpi, divide Δ(Xa–Xb) with 25.4 [mm/inch] to convert it to the distance in inches and multiply with 300 (number of dots per inch) to get the deviation A. The result obtained by converting the number of dots in compensation range shown in Table 1 based on this deviation A is shown in Table 2.

TABLE 2

| Dot position | |
|---|---|
| From 1st to $\left(\frac{(N - N1)}{2} + A\right)$ th | Compensation range X |
| From $\left(\frac{(N - N1)}{2} + 1 + A\right)$ th to $\left(\frac{(N + N1)}{2} - A\right)$ th | No-compensation range Y |
| From $\left(\frac{(N + N1)}{2} + 1 - A\right)$ th to Nth | Compensation range X |

In case when the recording paper position is to be compensated, a proper compensation-required range can be selected by modifying the reference number of dots according to Table 2 in executing the steps S22 and S23 shown in FIG. 10.

Although two kinds of recording paper with different widths are assumed in the above description, a case wherein three kinds of recording paper are used will be described in the following. Although this embodiment is similar to the above case, its feature is that the compensations were made in steps as the number of different widths increases.

Figure 12:
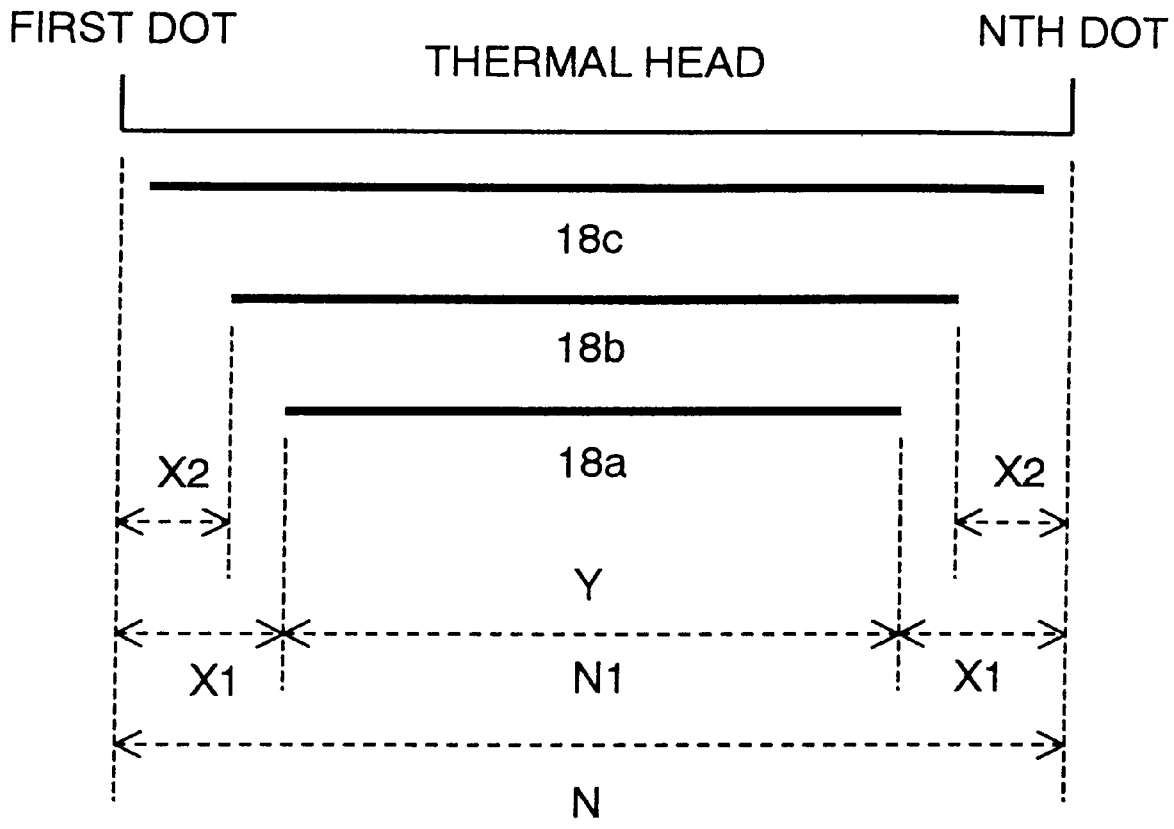
FIG. 12 is a view of the required compensation ranges for different paper widths related to another embodiment of the present invention.

A case with three different paper widths is shown in FIG. 12. The first recording paper with the narrowest width is represented by 18*a*, the second recording paper with the medium width is represented by 18*b*, and the third recording paper with the widest width is represented by 18*c*. The compensation range considering paper offset is as shown in Table 3 wherein: the total number of print dots of the thermal head is N; the number of dots in the printing range of the first recording paper 18*a* is N1; the number of dots in the printing range of the second recording paper 18*b* is N2; the number of dots in the printing range of the third recording paper 18*c* is N3; the compensation range in printing on the second recording paper 18*b* is X1; the compensation range in printing on the third recording paper 18*c* is X2; and the no-compensation range is Y.

The symbol A is the deviation of the first recording paper 18*a* and the symbol B is the deviation of the second recording paper 18*b*.

TABLE 3

| Dot position | |
|---|---|
| From 1st to $\left(\frac{(N - N1)}{2} + A\right)$ th | Compensation range X1 |
| From $\left(\frac{(N - N1)}{2} + 1 + A\right)$ th to $\left(\frac{(N + N1)}{2} - A\right)$ th | No-compensation range Y |
| From $\left(\frac{(N + N1)}{2} + 1 - A\right)$ th to Nth | Compensation range X1 |
| From 1st to $\left(\frac{(N - N2)}{2} + B\right)$ th | Compensation range X2 |
| From $\left(\frac{(N + N2)}{2} + 1 - B\right)$ th to Nth | Compensation range X2 |

In case of printing on the second recording paper 18*b*, compensations should be made in the compensation range X1. In other words, compensations are made the same way as in the case of two kinds of paper described before.

In case of printing on the third recording paper 18*c*, two kinds of density unevenness occur, the one due to the difference between the first recording paper 18*a* and the second recording paper 18*b*, and the other due to the difference between the second recording paper 18*b* and the third recording paper 18*c*.

Consequently, in case of the third recording paper with the widest width, compensations are first made in the compensation range X1 to determine the output of the thermal head for the compensation range X1, followed by compensations in the compensation range X2 to determine the output of the thermal head for the compensation range X2. The compensation values in the compensation range X1 are determined based on the compensation table obtained by counting the print lines (or number of sheets printed) of the first recording paper 18*a*. Similarly, the compensation values in the compensation range X2 are determined by counting the print lines (or number of sheets printed) of the second recording paper 18*b*.

Thus, recording paper of various widths can be managed properly by executing compensations in steps.

Next, another embodiment will be explained referring to FIGS. 13 through 15. In the above embodiments, the density unevenness caused by amount of wear is measured and stored in advance. The point of the present embodiment is, however, that the compensation value is determined by detecting an actual difference of density by means of a detector.

Figure 13:
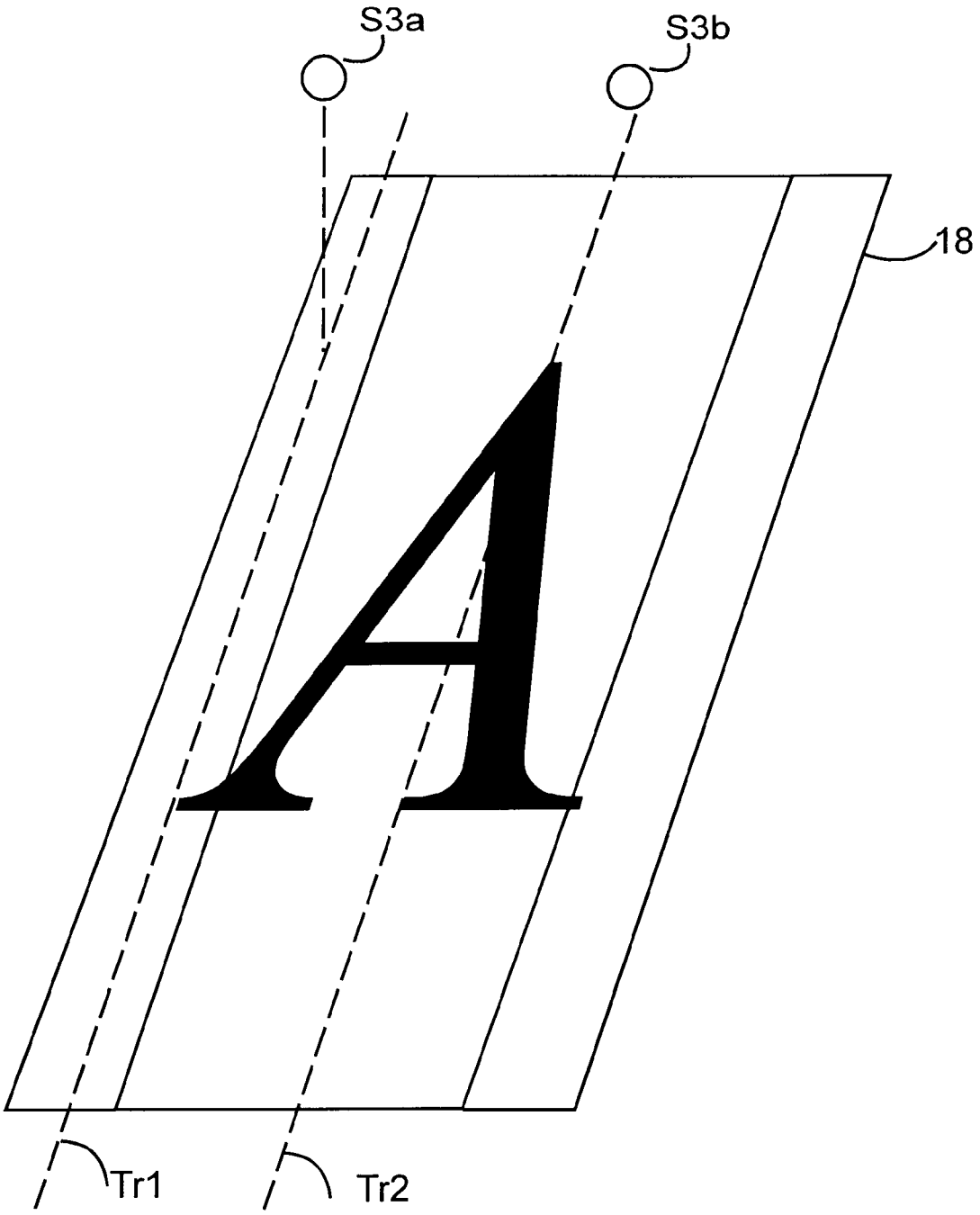
FIG. 13 is a schematic diagram illustrating a pair of sensors provided with a heat transfer recording apparatus according to another embodiment of the present invention.

As shown in FIG. 13, the detector includes a pair of sensors S3*a* and S3*b*. The sensor S3*a* is disposed in a position where a wide recording paper passes through and not a narrow recording paper. The sensor S3*b* is disposed in a position where all recording papers pass through regardless of the size of recording papers. In brief, one of the sensors is disposed in a position within a range Y3 corresponding to a narrow recording paper and the other of the sensors is disposed in a position within a range X3 corresponding to difference in width between a wide recording paper and a narrow recording paper. Incidentally, the symbol Tr1 indicates a broken line defined by a tracking line of reading by the sensor S3*a* above the compensation range X3. The symbol Tr2 indicates a broken line defined by a tracking line of reading by the sensor S3*b* above the no-compensation range Y3.

Figure 14A:
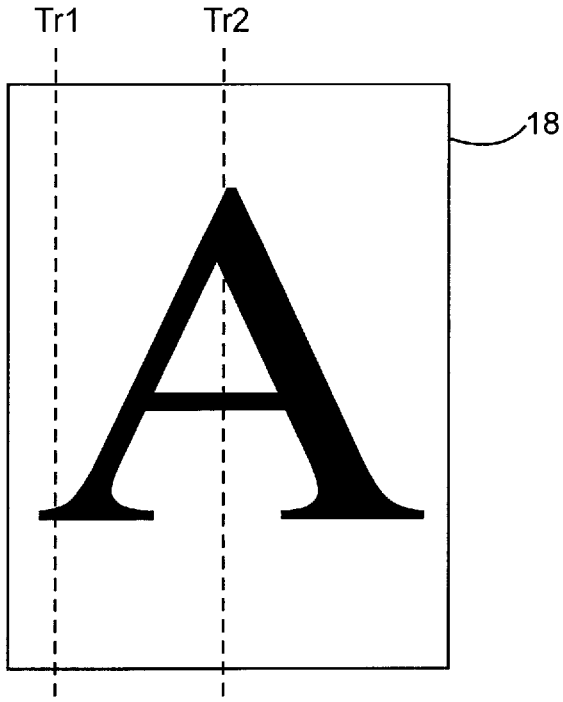
FIGS. 14A and 14B are views which illustrate the method of calculating a compensation value according to the present invention.
Figure 14B:
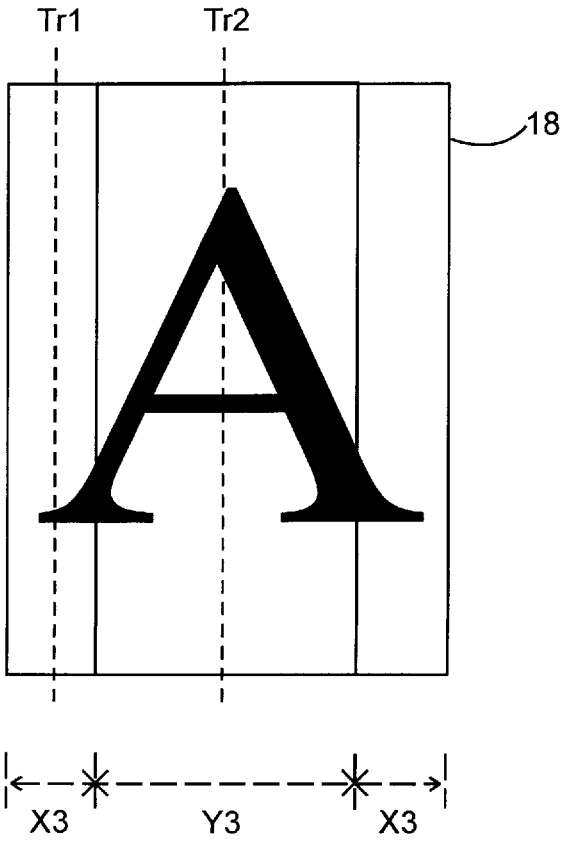

FIGS. 14A and 14B are outline drawings describing the method of calculating compensation value. The total image data corresponding to the tracking line Tr1 of the sensor S3*a* and the total image data corresponding to the tracking line Tr2 of the sensor S3*b*, which were stored to be printed on the recording paper, are referred as symbols $D_1$, $D_2$, respectively. And the total image data, which are actually detected, are referred as symbols $I_1$, $I_2$, respectively.

In case of no density unevenness the ratio $D_2/D_1$ is equal to the ratio $I_2/I_1$. As a matter of fact, the ratio $D_2/D_1$ is different from the print density ratio $I_2/I_1$ because of the occurrence of density unevenness. Thus, a product, which is related to the total stored data D2 corresponding to the position with thick density, is generated by multiplying the total stored data D1, which corresponds to the position with thin density, by the print density ratio $I_2/I_1$. The compensation value for each line is decided by subtracting the total stored data D2 from the product and then dividing the result by a number of lines. Therefore, the compensation becomes effective since the second recording paper.

Figure 15:
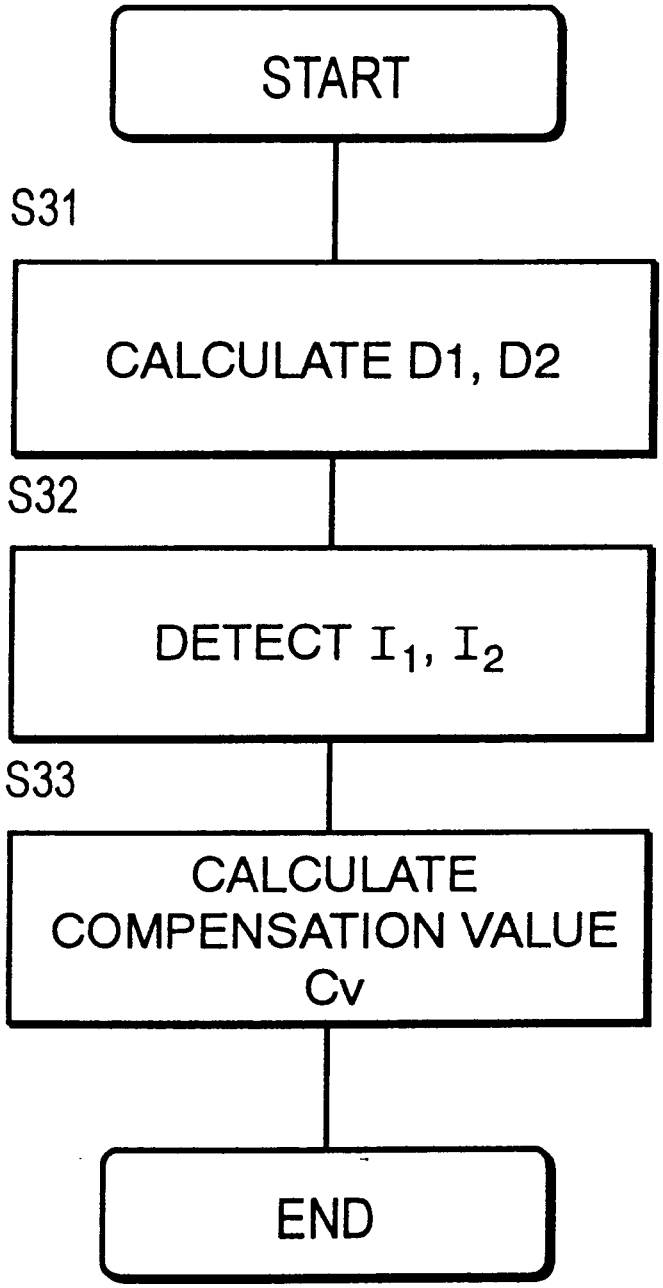
FIG. 15 is a flow chart of the method of calculating the compensation value.

FIG. 15 is a flow chart of the method of calculating compensation value.

First, image data corresponding to the tracking line Tr1, Tr2, which were stored in the memory of the heat transfer recording apparatus, are read out and added to calculate the total stored data D1, D2 (S31).

After printing, actual printed image data corresponding to the tracking line Tr1, Tr2, are measured. In particular, the total detected data $I_1$, $I_2$ outputted by sensors are stored as digital data (S32). Incidentally, the total detected data $I_1$, $I_2$ may be generated by A/D-converting outputs of sensors and accumulating or integrating the product by means of the CPU. Optionally, the total detected data $I_1$, $I_2$ may be generated by inputting outputs of the sensors into an integrating circuit and A/D-converting outputs of the integrating circuit.

Next, the compensation value Cv is decided using a number of lines L, and calculated values D1, D2, $I_1$, $I_2$, based on the following formula (S33).

$$Cv=(((I_2/I_1)\times D1)-D2)/L$$

Concerning the present embodiment, a pair of sensors is provided since the density compensation is for two kinds of recording paper with different widths. It is understood that more than two kinds of paper each with different width may be suitably applied by providing sensors corresponding to respective widths.

As has been described in the above, the influence of the density unevenness that is caused by prolonged use of the apparatus when printing is made on wide recording paper can be improved by making density compensations within the ranges that correspond to the width difference between narrow paper and wide paper.

Moreover, even if the paper passage is offset from the center, proper compensation ranges can be selected by adjusting the compensation ranges according to the position of the paper passage.

Furthermore, the density compensation can be determined based on the number of sheets printed as well as the number of print lines of narrow paper.

If there are more than two kinds of paper each with different width, the density consistencies due to the differences in the widths of paper can be improved by making compensations in steps corresponding to respective widths.

Furthermore, the compensation value may be determined by detecting an actual difference of density by means of a detector.

It is obvious that this invention is not limited to the particular embodiments shown and described above but may be variously changed and modified without departing from the technical concept of this invention. Further, the entire disclosure of Japanese Patent Application No. 09-212123 filed on Aug. 6, 1997, including the specification, claims, drawings and summary are incorporated herein by reference in its entirety.

What is claimed is:

1. A recording apparatus for forming images on recording paper, the recording paper having any one of a plurality of widths, using an ink film for forming ink layers on the recording paper, the recording apparatus comprising:

means for providing a difference in printing densities between a first region corresponding to narrow recording paper, and a second region corresponding to a difference in width between the narrow recording paper and wide recording paper; and a printing density controller for compensating for the difference in printing densities.

2. A recording apparatus according to claim 1, wherein a range corresponding to the difference in width between the narrow recording paper and the wide recording paper is modified according to recording paper passage position.

3. A recording apparatus according to claim 1, wherein compensation for the difference in printing densities is modified based on an amount of wear on an element of the recording apparatus by the narrow recording paper.

4. A recording apparatus according to claim 3, wherein said amount of wear on an element of the recording apparatus is calculated based on how many prints were made using the narrow recording paper.

5. A recording apparatus according to claim 3, wherein said amount of wear on an element of the recording apparatus is calculated based on how many lines were printed using the narrow recording paper.

6. A recording apparatus according to claim 3, further comprising a memory which stores data showing a relationship between the amount of wear on an element of the recording apparatus and an amount of compensation for the difference in printing densities.

7. A recording apparatus according to claim 1, wherein compensation for the difference in printing densities is made in steps corresponding to respective differences in width of recording papers.

8. A recording apparatus according to claim 1, wherein said recording apparatus is a printer which prints images recorded on photographic films.

9. A recording apparatus according to claim 1, wherein said recording apparatus is a printer which prints images formed by and transferred from a computer.

10. A recording apparatus according to claim 1, wherein the means for providing a difference in printing densities comprises a memory which stores data for compensating for the difference in printing densities.

11. A recording apparatus according to claim 1, wherein the means for providing a difference in printing densities comprises a detector which detects the difference in printing densities.

12. A recording apparatus according to claim 1, wherein said means for providing a difference in printing densities comprises a first sensor which detects a printing density of the first region corresponding to narrow recording paper, and a second sensor which detects a printing density of the second region corresponding to the difference in width between the narrow recording paper and wide recording paper.

13. A recording apparatus according to claim 1, wherein said density controller makes density compensation only when an image is printed on the wide recording paper.

14. A recording apparatus for forming images on recording paper with varying widths using an ink film with ink layers formed thereon, the recording apparatus comprising:

a detector which detects image density in a plurality of different positions of recording paper, wherein said detector includes a pair of sensors, one of which detects a density of a position corresponding to narrow recording paper and the other of which detects a density of a position corresponding to a difference in width between wide recording paper and narrow recording paper;

a calculator which calculates density compensation amount based on the detected image density; and a density controller which makes density compensation corresponding to the calculated density compensation amount.

15. A recording apparatus according to claim 14, wherein said apparatus is a printer which prints images recorded on photographic films.

16. A recording apparatus according to claim 14, wherein said apparatus is a printer which prints images formed by and transferred from a computer.

17. A recording apparatus according to claim 14, further comprising an image memory which memorizes image to be printed, and wherein said calculator calculates density compensation amount by comparing a detected image density and density of image memorized in said image memory.

18. A recording apparatus for forming images on recording paper using an ink film with ink layers formed thereon, the apparatus comprising:

means for guiding the recording paper through the recording apparatus, wherein the recording paper can have any one of a plurality of widths; and means for transferring ink from the ink film to the recording paper, wherein the ink is transferred to produce a pattern with a predetermined density; and a density controller for compensating for variations from the predetermined density in a region which corresponds to a difference in width between wide recording paper and narrow recording paper.

* * * * *